US010870276B2

(12) United States Patent
McAvoy

(10) Patent No.: US 10,870,276 B2
(45) Date of Patent: Dec. 22, 2020

(54) DROPLET EJECTOR

(71) Applicant: Gregory John McAvoy, Greystones (IE)

(72) Inventor: Gregory John McAvoy, Greystones (IE)

( * ) Notice: Subject to any disclaimer, the term of this patent is extended or adjusted under 35 U.S.C. 154(b) by 0 days.

(21) Appl. No.: 16/334,922

(22) PCT Filed: Sep. 19, 2017

(86) PCT No.: PCT/EP2017/073671
§ 371 (c)(1),
(2) Date: Mar. 20, 2019

(87) PCT Pub. No.: WO2018/054917
PCT Pub. Date: Mar. 29, 2018

(65) Prior Publication Data

US 2019/0283424 A1 Sep. 19, 2019

(30) Foreign Application Priority Data

Sep. 23, 2016 (GB) ..... 1616192.9

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1628* (2013.01); *B41J 2/1642* (2013.01);
(Continued)

(58) Field of Classification Search
CPC ..... B41J 2/14233; B41J 2/161; B41J 2/164; B41J 2/04585; B41J 2/04573; B41J 2/04591; B41J 2/04593
(Continued)

(56) References Cited

U.S. PATENT DOCUMENTS 7,287,840 B2 * 10/2007 Miyazawa ..... B41J 2/14233 252/62.9 PZ
2011/0037813 A1 2/2011 Nakatani
(Continued)

FOREIGN PATENT DOCUMENTS

JP H03-65350 3/1991
JP 2015-147425 8/2015

OTHER PUBLICATIONS

International Search Report for PCT/EP2017/073671, dated Jan. 3, 2018, 4 pages.

*Primary Examiner* — An H Do
(74) *Attorney, Agent, or Firm* — Nixon & Vanderhye P.C.

(57) ABSTRACT

A droplet ejector for a printhead comprises: a substrate having a mounting surface and an opposite nozzle surface; at least one electronic component integrated with the substrate; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer; a piezoelectric actuator formed on at least a portion of the nozzle portion of the nozzle-forming layer; and a protective layer covering the piezoelectric actuator and the in nozzle forming layer. The piezoelectric actuator comprises a piezoelectric body provided between first and second electrodes. At least one of the said first and second electrodes is electrically connected to the at least one electronic component. The piezoelectric body comprises one or more piezoelectric materials processable at a temperature below 450° C.

31 Claims, 10 Drawing Sheets

(52) U.S. Cl.
CPC ..... *B41J 2/1646* (2013.01); *B41J 2/164* (2013.01); *B41J 2202/15* (2013.01)

(58) Field of Classification Search
USPC ..... 347/68, 70–72
See application file for complete search history.

(56) References Cited

U.S. PATENT DOCUMENTS

| | | | |
|---|---|---|---|
| 2013/0070030 | A1 | 3/2013 | Kusunoki et al. |
| 2014/0063095 | A1 | 3/2014 | Yokoyama et al. |

* cited by examiner

| Material | Deposition Method | Peak Temperature | CMOS compatability | $d_{31}$ (pC/N) |
|---|---|---|---|---|
| PZT | PVD + Anneal + Poling | >450°C | No | -152 to -259 |
| PZT | Sol Gel + Anneal + Poling | 650°C | No | -116 |
| ZnO | PVD | Room Temp | Yes | -3.3 |
| AlN | PVD | 200° C | Yes | -1.9 |
| ScAlN | PVD | Room Temp | Yes | -5.8 |

FIG. 10

DROPLET EJECTOR

This application is the U.S. national phase of International Application No. PCT/EP2017/073671 filed 19 Sep. 2017, which designated the U.S. and claims priority to GB Patent Application No. 1616192.9 filed 23 Sep. 2016, the entire contents of each of which are hereby incorporated by reference.

FIELD OF THE INVENTION

The invention relates to droplet ejectors for printheads, printheads comprising droplet ejectors, methods for manufacturing droplet ejectors for printheads, and methods for manufacturing printheads comprising droplet ejectors.

BACKGROUND TO THE INVENTION

Inkjet printers are used to recreate digital images on a print medium (such as paper) by propelling droplets of ink onto the medium. Many inkjet printers incorporate "drop on demand" technology wherein the sequential ejection of individual ink droplets from the inkjet nozzle of a printhead is controlled. The ink droplets are ejected with sufficient momentum that they adhere to the medium. Each droplet is ejected according to an applied drive signal, which differentiates drop on demand inkjet printers from continuous inkjet devices where a continuous stream of ink droplets is generated by pumping ink through a microscopic nozzle.

Two of the most commercially successful drop on demand technologies are thermal inkjet printers and piezoelectric inkjet printers. Thermal inkjet printers require the printing fluid to include a volatile component, such as water. A heating element causes the spontaneous nucleation of a bubble in the volatile fluid within the printhead, forcing a droplet of fluid to be ejected through a nozzle. Piezoelectric inkjet printers instead incorporate a piezoelectric actuator into a wall of a fluid chamber. Deformation of a piezoelectric element causes deflection of the piezoelectric actuator, inducing a pressure change in the printing fluid stored within the fluid chamber and thereby causing droplet ejection through a nozzle.

Thermal inkjet printers can only be used to jet a very small subset of printing fluids (as the fluids must exhibit the appropriate volatility). Thermal inkjet printers also suffer from kogation, wherein dried ink residue deposits on the heating element, which reduces their usable lifetime.

Piezoelectric inkjet printers are usable with a range of fluids and have longer operational lifetimes than thermal inkjet printers, because they do not suffer from kogation. However, only very low nozzle counts per printhead are typically achievable with existing piezoelectric technologies compared to thermal inkjet printheads. Piezoelectric printheads typically also suffer from acoustic cross talk problems, wherein neighbouring piezoelectric actuators and fluid channels interact with one another through pressure waves in the fluid.

The present invention aims to provide an improved piezoelectric droplet ejector for a printhead which reduces acoustic cross talk between neighbouring piezoelectric droplet ejectors on a printhead and which permits higher nozzle counts to be achieved.

SUMMARY OF THE INVENTION

A first aspect of the invention provides a droplet ejector for a printhead. The droplet ejector typically comprises: a substrate having a mounting surface and an opposite nozzle surface; at least one electronic component (e.g. of drive circuitry) integrated with the substrate; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer; a piezoelectric actuator formed on at least a portion of the nozzle portion of the nozzle-forming layer; and a protective layer covering the piezoelectric actuator and the nozzle-forming layer. The piezoelectric actuator typically comprises a piezoelectric body provided between first and second electrodes. At least one of the said first and second electrodes is typically electrically connected to the at least one electronic component (e.g. of the drive circuitry). The piezoelectric body typically comprises (e.g. is formed from) one or more piezoelectric materials processable at a temperature below 450° C.

Above 300° C., integrated electronic components (e.g. CMOS electronic components) typically begin to degrade, impairing device operation and reducing efficiency. Above 450° C., integrated electronic components (e.g. CMOS electronic components) typically degrade even more substantially. Use of piezoelectric materials processable at a temperature below 450° C. therefore permits processing of, and integration of, the piezoelectric actuator with the at least one electronic component (e.g. of the drive circuitry) without substantial damage to the said at least one electronic component.

It may be that the piezoelectric body comprises (e.g. is formed from) one or more piezoelectric materials processable at a temperature below 300° C. Use of piezoelectric materials processable at a temperature below 300° C. permits processing of, and integration of, the piezoelectric actuator with the at least one electronic component (e.g. of the drive circuitry) with even less damage to the said at least one electronic component. Use of piezoelectric materials processable at a temperature below 300° C. typically permits a higher yield of functioning devices to be achieved from large-scale manufacture of multiple fluid ejectors on a single substrate (e.g. from a single substrate wafer).

By integrating the piezoelectric actuator with the least one electronic component (e.g. drive electronics), the need to provide separate droplet ejector drive electronics (typically provided separate to any piezoelectric printhead microchip in existing devices) is reduced or removed. A large number of droplet ejectors may therefore be closely integrated on one chip, increasing the nozzle count per chip, reducing the overall printhead size, and permitting a higher printhead nozzle density than is achievable with existing piezoelectric printheads. Other benefits associated with integration on a single printhead chip include eventual manufacturing cost reductions, modularity and device reliability.

Piezoelectric materials which are processable below 450° C. (or below 300° C.) typically have poorer piezoelectric properties (e.g. lower piezoelectric constants) than piezoelectric materials which require processing at higher temperatures. For example, a piezoelectric actuator formed from a high-temperature processable piezoelectric material such as lead zirconate titanate (PZT) is able to exert a force over an order of magnitude greater than a piezoelectric actuator formed from a low-temperature processable piezoelectric material such as aluminium nitride (AlN), all other factors being equal.

However, the inventor has found that, by providing the piezoelectric actuator on the nozzle-portion of the nozzle-forming layer (rather than on a fluid chamber wall provided further away from the fluid chamber outlet, as is found in existing droplet ejectors), the droplet ejection efficiency of the droplet ejector may be improved sufficiently that use of low-temperature processable piezoelectric materials becomes feasible. It is the particular structure of the droplet ejector in the present invention which enables the use of low-temperature processable piezoelectric materials, which itself then permits integration of the droplet ejector with drive electronics.

In particular, application of an electric field between the first and second electrodes typically induces deformation of the piezoelectric actuator, which causes a highly damped oscillation of the nozzle-portion of the nozzle-forming layer. Oscillation of the nozzle-portion of the nozzle-forming layer sets up an oscillating pressure field within the fluid chamber, driving ejection of a droplet through the fluid chamber outlet. By displacing the nozzle portion of the nozzle-forming layer (rather than displacing a fluid chamber wall provided further away from the fluid chamber outlet), relatively small fluid pressures, and thus relatively small actuation forces, are required to eject a droplet of fluid, thereby facilitating use of low-temperature processable piezoelectric materials having lower piezoelectric constants.

Because the force exerted by the piezoelectric actuator comprising low-temperature processable piezoelectric materials is relatively low (compared to devices using piezoelectric actuators comprising high-temperature processable piezoelectric materials), and thus because relatively low fluid pressures are achieved, acoustic cross talk (by way of acoustic waves propagating through the printhead) between neighbouring fluid chambers on a printhead is reduced. The lower pressures reduce fluidic compressibility, making acoustic cross talk less likely. Lower levels of acoustic cross talk permit even closer integration of neighbouring droplet ejectors on a printhead without a reduction in print quality.

Processing of a piezoelectric material typically comprises deposition of said piezoelectric material. Processing of a piezoelectric material may also comprise further processing of the piezoelectric material after deposition (i.e. post-deposition processing, or 'post-processing', of the deposited piezoelectric material). Processing of a piezoelectric material may comprise (i.e. post-deposition) annealing of the piezoelectric material.

A piezoelectric material processable at a temperature below 450° C. (or below 300° C.) is typically a piezoelectric material which is depositable at a temperature below 450° C. (or below 300° C.). A piezoelectric material processable at a temperature below 450° C. (or below 300° C.) does not typically require any post-deposition processing (such as post-deposition annealing) at a temperature at or above 450° C. (or at or above 300° C.). A piezoelectric material processable at a temperature below 450° C. (or below 300° C.) is therefore typically a piezoelectric material which is annealable (after deposition) at a temperature below 450° C. (or below 300° C.) (i.e. if annealing of the piezoelectric material is required to render the piezoelectric body piezoelectric).

The one or more piezoelectric materials are typically processable (e.g. depositable and, if required, annealable) at a temperature below 450° C. (or below 300° C.) such that the piezoelectric actuator is manufacturable at a temperature below 450° C. (or below 300° C.). Manufacture of the piezoelectric actuator at a temperature below 450° C. (or below 300° C.) permits integration of the piezoelectric actuator with the at least one electronic component integrated with the substrate.

The piezoelectric body is therefore typically formable (e.g. by deposition and, if required, annealing of the one or more piezoelectric materials) at a temperature below 450° C. (or below 300° C.).

The one or more piezoelectric materials are typically processable (e.g. depositable and, if required, annealable) at a substrate temperature below 450° C. (or below 300° C.). In other words, the temperature of the substrate does not typically reach or exceed 450° C. (or 300° C.) during processing (e.g. deposition and, if required, annealing) of the one or more piezoelectric materials. The temperature of the substrate does not typically reach or exceed 450° C. (or 300° C.) during formation of the piezoelectric body. The temperature of the substrate does not typically reach of exceed 450° C. (or 300° C.) during manufacture of the piezoelectric actuator. It may be that the temperature of the substrate does not reach or exceed 450° C. (or 300° C.) during manufacture of the (e.g. entire) droplet ejector.

The piezoelectric body is typically depositable (e.g. deposited) by one or more (e.g. low-temperature) physical vapour deposition (PVD) methods. The piezoelectric body is typically depositable (e.g. deposited) by one or more (e.g. low-temperature) physical vapour deposition methods at a temperature (i.e. at a substrate temperature) below 450° C. (or more preferably below 300° C.).

It may be that the piezoelectric body comprises (e.g. is formed from) one or more (e.g. low-temperature) PVD-depositable piezoelectric materials. It may be that the piezoelectric body comprises (e.g. is formed from) one or more (e.g. low-temperature) PVD-deposited piezoelectric materials.

Physical vapour deposition methods (e.g. low-temperature physical vapour deposition methods) may comprise one or more of the following deposition methods: cathodic arc deposition, electron beam physical vapour deposition, evaporative deposition, pulsed laser deposition, sputter deposition. Sputter deposition may comprise sputtering of material from single or multiple sputtering targets.

The one or more piezoelectric materials typically have deposition temperatures below 450° C. (or below 300° C.). The one or more piezoelectric materials may have PVD-deposition temperatures below 450° C. (or below 300° C.). The one or more piezoelectric materials may have sputtering temperatures below 450° C. (or below 300° C.). The one or more piezoelectric materials may have post-deposition annealing temperatures below 450° C. (or below 300° C.). It will be understood that the deposition temperature, the PVD-deposition temperature, the sputtering temperature or the annealing temperature is typically the temperature of the substrate during the respective process.

The piezoelectric body may comprise (e.g. be formed from) one piezoelectric material. Alternatively, the piezoelectric body may comprise (e.g. be formed from) more than one piezoelectric material.

The piezoelectric body may comprise (e.g. be formed from) a ceramic material comprising aluminium and nitrogen and optionally one or more elements selected from: scandium, yttrium, titanium, magnesium, hafnium, zirconium, tin, chromium, boron.

The piezoelectric body may comprise (e.g. be formed from) aluminium nitride (AlN).

The piezoelectric body may comprise (e.g. be formed from) zinc oxide (ZnO).

The one or more piezoelectric materials may comprise (e.g. consist of) aluminium nitride and/or zinc oxide.

Aluminium nitride may consist of pure aluminium nitride. Alternatively, aluminium nitride may comprise one or more elements (i.e. aluminium nitride may comprise aluminium nitride compounds). Aluminium nitride may comprise one or more of the following elements: scandium, yttrium, titanium, magnesium, hafnium, zirconium, tin, chromium, boron.

The piezoelectric body may comprise (e.g. be formed from) scandium aluminium nitride (ScAlN). The percentage of scandium in scandium aluminium nitride is typically chosen to optimize the $d_{31}$ piezoelectric constant within the limits of manufacturability. For example, the value of x in $Sc_xAl_{1-x}N$ is typically chosen from the range $0<x\leq 0.5$. Greater fractions of scandium typically result in larger values of $d_{31}$ (i.e. stronger piezoelectric effects). The mass percentage (i.e. the weight percentage) of scandium in scandium aluminium nitride is typically greater than 5%. The mass percentage (i.e. the weight percentage) of scandium in scandium aluminium nitride is typically greater than 10%. The mass percentage (i.e. the weight percentage) of scandium in scandium aluminium nitride is typically greater than 20%. The mass percentage (i.e. the weight percentage) of scandium in scandium aluminium nitride is typically greater than 30%. The mass percentage (i.e. the weight percentage) of scandium in scandium aluminium nitride is typically greater than 40%. The mass percentage (i.e. the weight percentage) of scandium in scandium aluminium nitride may be less than or equal to 50%.

Aluminium nitride, including aluminium nitride compounds (and in particular scandium aluminium nitride), and zinc oxide are piezoelectric materials which may be deposited below 450° C., or more preferably below 300° C. Aluminium nitride, including aluminium nitride compounds (and in particular scandium aluminium nitride), and zinc oxide are piezoelectric materials which may be deposited by physical vapour deposition (e.g. sputtering) below 450° C., or more preferably below 300° C. Aluminium nitride, including aluminium nitride compounds (and in particular scandium aluminium nitride), and zinc oxide are piezoelectric materials which do not typically require annealing after deposition.

The piezoelectric body may comprise (e.g. be formed from) aluminium nitride (e.g. aluminium nitride compounds, for example scandium aluminium nitride) and/or zinc oxide deposited by physical vapour deposition below 450° C., or more preferably below 300° C.

The piezoelectric body may comprise (e.g. be formed from) one or more III-V and/or II-VI semiconductors (i.e. compound semiconductors comprising elements from Groups III and V and/or Groups II and VI of the Periodic Table). Such III-V and II-VI semiconductors typically crystallise in the hexagonal wurtzite crystal structure. III-V and II-VI semiconductors crystallising in the hexagonal wurtzite crystal structure are typically piezoelectric due to their non-centrosymmetric crystal structure.

The piezoelectric body may comprise (e.g. be formed from or consist of) non-ferroelectric piezoelectric materials. The one or more piezoelectric materials may be one or more non-ferroelectric piezoelectric materials. Ferroelectric materials typically require (i.e. post-deposition) poling under strong applied electric fields. Non-ferroelectric piezoelectric materials typically do not require poling.

The piezoelectric body typically has a piezoelectric constant $d_{31}$ having a magnitude less than 30 pC/N, or more typically less than 20 pC/N, or even more typically less than 10 pC/N. The one or more piezoelectric materials typically have piezoelectric constants $d_{31}$ having magnitudes less than 30 pC/N, or more typically less than 20 pC/N, or even more typically less than 10 pC/N.

The one or more piezoelectric materials are typically CMOS-compatible. By this, it will be understood that the one or more piezoelectric materials do not typically comprise, or are typically processable (e.g. depositable, and if required, annealable) without use of, substances which damage CMOS electronic structures. For example, processing (e.g. deposition, and if required, annealing) of the one or more piezoelectric materials does not typically include use of (e.g. strong) acids (such as hydrochloric acid) and/or (e.g. strong) alkalis (such as potassium hydroxide).

It may be that the nozzle-forming layer comprises a nozzle plate. The nozzle plate may consist of a single layer of material. Alternatively, the nozzle plate may consist of a laminate structure of two or more layers of (e.g. different) material. The nozzle plate is typically formed from one or more materials each having a Young's modulus (i.e. tensile elastic modulus) of between around 70 GPa and around 300 GPa. The nozzle plate may be formed from one or more of: silicon dioxide ($SiO_2$), silicon nitride ($Si_3N_4$), silicon carbide (SiC), silicon oxynitride ($SiO_xN_y$).

It may be that the nozzle forming layer comprises an electrical interconnect layer. The electrical interconnect layer typically comprises one or more electrical connections (e.g. electrical wiring) surrounded by electrical insulator. The one or more electrical connections (e.g. electrical wiring) are typically formed from a metal or metal alloy. Suitable metals include aluminium, copper and tungsten, and alloys thereof. The electrical insulator is typically formed from a dielectric material such as silicon dioxide ($SiO_2$), silicon nitride ($Si_3N_4$) or silicon oxynitride ($SiO_xN_y$).

It may be that the electrical interconnect layer is provided (e.g. formed) between the substrate and the nozzle plate. It may be that the electrical interconnect layer is provided (e.g. formed) on the second surface of the substrate, and the nozzle-plate is provided (e.g. formed) on the electrical interconnect layer. The nozzle-plate may comprise one or more apertures through which electrical connections to the electrical interconnect layer may be formed.

It may be that a nozzle portion of the electrical interconnect layer forms at least a part of the nozzle portion of the nozzle-forming layer. It may be that the nozzle portion of the electrical interconnect layer consists of dielectric material. Alternatively, it maybe that the electrical interconnect layer does not form part of the nozzle portion of the nozzle-forming layer.

The first and second electrodes typically comprise one or more layers of metal (such as titanium, platinum, aluminium, tungsten or alloys thereof). The first and second electrodes are typically deposited by (e.g. low-temperature) PVD at a temperature (i.e. at a substrate temperature) below 450° C. (or more typically below 300° C.).

It may be that the first electrode is electrically connected to the at least one electronic component. It may be that the second electrode is electrically connected to the at least one electronic component. It may be that both the first and second electrodes are electrically connected to the at least one electronic component.

It may be that the droplet ejector comprises drive circuitry. The drive circuitry is typically integrated with the substrate. The at least one electronic component typically forms part of the drive circuitry. It may be that at least one of the first and second electrodes is connected electrically to the drive circuitry. It may be that the first electrode is electrically connected to the drive circuitry. It may be that the second electrode is electrically connected to the drive circuitry. It may be that both the first and second electrodes are electrically connected to the drive circuitry.

It may be that the at least one electronic component is configured to provide a (e.g. variable) potential difference (i.e. a voltage) between the first and second electrodes (i.e. in use). It may be that the at least one electronic component is configured to vary the potential difference (i.e. voltage) between the first and second electrodes (i.e. in use).

It may be that the drive circuitry is configured to provide a (e.g. variable) potential difference (i.e. a voltage) between the first and second electrodes (i.e. in use). It may be that the drive circuitry is configured to vary the potential difference (i.e. voltage) between the first and second electrodes (i.e. in use).

The at least one electronic component may comprise at least one active electronic component (e.g. a transistor). Additionally or alternatively, the at least one electronic component may comprise at least one passive electronic component (e.g. a resistor).

The at least one electronic component may comprise at least one CMOS (i.e. complementary metal-oxide-semiconductor) electronic component integrated with the substrate.

The drive circuitry may comprise CMOS circuitry (e.g. CMOS electronics) integrated with the substrate.

CMOS electronic components (e.g. CMOS electronic components forming part of CMOS circuitry, i.e. CMOS electronics) are typically formed (e.g. grown) on the substrate by way of standard CMOS manufacturing methods. For example, integrated CMOS electronic components may be deposited by way of one or more of the following methods: physical vapour deposition, chemical vapour deposition, electrochemical deposition, molecular beam epitaxy, atomic layer deposition, ion implantation, photopatterning, reactive ion etching, plasma exposure.

The protective layer is typically formed on the piezoelectric actuator and the nozzle-forming layer. The protective layer typically covers the piezoelectric actuator and the nozzle-forming layer. The protective layer is typically chemically inert, impermeable and/or fluid-repellent. The protective layer should have a low Young's modulus (i.e. tensile elastic modulus). The protective layer should have a Young's modulus which is substantially smaller than the Young's modulus of the nozzle-forming layer (and in particular the nozzle-plate) and/or the piezoelectric body. The protective layer typically has a Young's modulus less than 50 GPa. The protective layer may be formed from one or more polymeric materials such as polyimides or polytetrafluoroethylene (PTFE), or from diamond-like carbon (DLC).

The droplet ejector is typically monolithic. The droplet ejector is typically integrated (i.e. an integrated droplet ejector). The substrate, nozzle-forming layer, piezoelectric actuator, fluid chamber, the at least one electronic component (e.g. of the drive electronics) and the protective layer are typically integrated (i.e. with one another). The droplet ejector is typically manufactured by integrally forming the substrate, nozzle-forming layer, piezoelectric actuator, the at least one electronic component (e.g. of the drive electronics) and the protective layer through one or more deposition processes. The droplet ejector is not typically manufactured by bonding together one or more individually-formed components (e.g. individually-formed substrates, nozzle-forming layers, piezoelectric actuators, electronic components and/or protective layers).

It may be that the mounting surface of the substrate comprises a fluid inlet aperture. The fluid inlet aperture is typically in fluid communication with the fluid chamber.

The fluid chamber may be substantially elongate. The fluid chamber typically extends from the mounting surface of the substrate to the nozzle surface. The fluid chamber typically extends along a direction substantially perpendicular to the mounting surface and/or the nozzle surface.

The fluid chamber may be substantially circular in cross-section through the plane of the substrate. The fluid chamber may be substantially polygonal in cross-section through the plane of the substrate (for example, the fluid chamber may be substantially square in cross-section). The fluid chamber may be many-sided in cross-section through the plane of the substrate.

The fluid chamber may be substantially prismatic in shape. A longitudinal axis of the substantially prismatic fluid chamber typically extends along the direction substantially perpendicular to the mounting surface and/or the nozzle surface.

The fluid chamber may be substantially cylindrical in shape. A longitudinal axis of the substantially cylindrical chamber typically extends along the direction substantially perpendicular to the mounting surface and/or the nozzle surface.

The nozzle portion of the nozzle-forming layer is typically the portion of the nozzle-forming layer which extends across the fluid chamber, thereby forming at least one wall of the fluid chamber.

The nozzle portion of the nozzle forming layer typically protrudes beyond the substrate and is therefore bendable independently of the substrate.

It may be that the nozzle portion of the nozzle-forming layer is substantially annular. It may be that the perimeter of the nozzle portion of the nozzle-forming layer is substantially polygonal. It may be that perimeter of the nozzle portion of the nozzle-forming layer is many-sided. The nozzle portion of the nozzle-forming layer typically comprises an aperture. The aperture may be substantially circular. The aperture may be substantially polygonal. The aperture may be many-sided.

It may be that the nozzle portion of the nozzle-forming layer (i.e. the portion of the nozzle-forming layer which extends across the fluid chamber, thereby forming at least one wall of the fluid chamber) is shaped substantially similarly to the shape of the fluid chamber in cross-section in the plane of the substrate. For example, where the fluid chamber is substantially cylindrical (i.e. substantially circular in cross section), the perimeter of the nozzle portion of the nozzle-forming layer is substantially circular.

The printhead may be an inkjet printhead. The droplet ejector may be a droplet ejector for (e.g. configured for use in) an inkjet printhead. The droplet ejector may be an inkjet droplet ejector.

The printhead may be configured to print fluids (e.g. functional fluids) for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

A second aspect of the invention provides a printhead comprising a plurality of droplet ejectors according to the first aspect of the invention. It may be that the plurality of droplet ejectors share a common substrate. For example, it may be that the plurality of droplet ejectors are integrated on said common substrate.

The printhead may be an inkjet printhead. Each of the plurality of droplet ejectors may be an inkjet droplet ejector.

The printhead may be configured to print functional fluids, such as for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

A third aspect of the invention provides a method of manufacturing a droplet ejector for a printhead, the method comprising: providing a substrate having a first surface and a second surface opposite the first surface; forming at least one electronic component in or on the second surface of the substrate; forming a nozzle-forming layer on the second surface of the substrate; forming a piezoelectric actuator on the nozzle-forming layer at a temperature below 450° C.; forming a protective layer covering the piezoelectric actuator and the nozzle-forming layer; and forming a fluid chamber in the substrate.

The step of forming the piezoelectric actuator typically comprises: forming a first electrode on the nozzle-forming layer; forming at least one layer of one or more piezoelectric materials on the first electrode at a temperature below 450° C.; and forming a second electrode on the at least one layer of one or more piezoelectric materials. The steps of forming the first electrode and forming the second electrode are also typically carried out at a temperature below 450° C.

Above 300° C., integrated electronic components (e.g. CMOS electronic components) typically begin to degrade, impairing device operation and reducing efficiency. Above 450° C., integrated electronic components (e.g. CMOS electronic components) typically degrade even more substantially. Forming the piezoelectric actuator (e.g. forming the first electrode, the one or more piezoelectric materials and the second electrode) at a temperature below 450° C. therefore permits integration of the piezoelectric actuator with the at least one electronic component (e.g. of the drive circuitry) without substantial damage to the said at least one electronic component.

It may be that the method comprises forming the piezoelectric actuator on the nozzle-forming layer at a temperature below 300° C. The step of forming the piezoelectric actuator may comprise: forming a first electrode on the nozzle-forming layer; forming at least one layer of one or more piezoelectric materials on the first electrode at a temperature below 300° C.; and forming a second electrode on the at least one layer of one or more piezoelectric materials. The steps of forming the first electrode and forming the second electrode may also be carried out at a temperature below 300° C. Forming the piezoelectric actuator (e.g. forming the first electrode, the one or more piezoelectric materials and the second electrode) at a temperature at a temperature below 300° C. permits integration of the piezoelectric actuator with the at least one electronic component (e.g. of the drive circuitry) with even less damage to the said at least one electronic component. This typically permits a higher yield of functioning devices to be achieved from large-scale manufacture of multiple fluid ejectors on a single substrate wafer.

The method typically comprises forming the piezoelectric actuator on the nozzle-forming layer at a substrate temperature below 450° C. (or below 300° C.). In other words, the temperature of the substrate does not typically reach or exceed 450° C. (or below 300° C.) during forming the piezoelectric actuator. The step of forming the piezoelectric actuator therefore typically comprises: forming a first electrode on the nozzle-forming layer; forming at least one layer of one or more piezoelectric materials on the first electrode at a substrate temperature below 450° C. (or below 300° C.); and forming a second electrode on the at least one layer of one or more piezoelectric materials. The steps of forming the first electrode and forming the second electrode are also typically carried out at a substrate temperature below 450° C. (or below 300° C.). It may be that the temperature of the substrate does not reach or exceed 450° C. (or 300° C.) during manufacture of the (e.g. entire) droplet ejector. It may be that the steps of forming the nozzle-forming layer, forming the protective layer and forming the fluid chamber are performed at a temperature less than 450° C. (or more typically below 300° C.).

It may be that the step of forming the nozzle-forming layer comprises forming a nozzle aperture in said nozzle-forming layer. It may be that the nozzle-forming layer is formed on one or more portions of the second surface of the substrate, thereby defining the nozzle aperture. Alternatively, it may be that the nozzle-forming layer is first formed on the second surface of the substrate and subsequently a portion of the nozzle-forming layer is removed to thereby define the nozzle-aperture. The nozzle-aperture typically extends through a full thickness of the nozzle-forming layer (i.e. in a direction substantially perpendicular to the first and/or or second surface of the substrate).

The step of forming the fluid chamber in the substrate typically comprises forming a recess in the substrate. It may be that the recess (i.e. the fluid chamber) is formed in the first surface of the substrate. It may be that the step of forming the recess (i.e. the fluid chamber) is performed after the step of forming the nozzle-forming layer. It may be that the step of forming the recess (i.e. the fluid chamber) is performed after the step of forming the piezoelectric actuator on the nozzle-forming layer. It may be that the step of forming the recess (i.e. the fluid chamber) is performed after the step of forming the protective layer. For example, it may be that the method comprises: first, providing the substrate having the first surface and the second surface opposite the first surface; then forming the at least one electronic component in or on the second surface of the substrate; then forming the nozzle-forming layer on the second surface of the substrate; then forming the piezoelectric actuator on the nozzle-forming layer at a temperature below 450° C.; then forming the protective layer covering the piezoelectric actuator and the nozzle-forming layer; and then forming the fluid chamber in the substrate.

It may be that the step of forming the recess (i.e. the fluid chamber) in the substrate comprises forming said recess (i.e. said fluid chamber) through a full thickness of the substrate (i.e. from the first surface to the second surface). The recess (i.e. the fluid chamber) formed in the substrate typically extends through the full thickness of the substrate (i.e. from the first surface to the second surface). The recess (i.e. the fluid chamber) does not typically extended through the nozzle-forming layer.

The recess (i.e. the fluid chamber) is typically formed in the substrate at a location which overlaps (e.g. coincides) with the location of the aperture in the nozzle-forming layer. A portion of the nozzle-forming layer (e.g. a nozzle portion of the nozzle-forming layer) typically forms at least one wall of the recess (i.e. the fluid chamber). The nozzle portion of the nozzle-forming layer typically extends across a portion of the recess (i.e. the fluid chamber). The recess (i.e. the fluid chamber) is typically in fluid communication with the nozzle aperture. The nozzle aperture in the nozzle-forming layer is typically an aperture extending through the nozzle-forming layer and into the recess (i.e. the fluid chamber). The nozzle aperture therefore typically defines a fluid chamber outlet. A fluid flow path is typically defined from the first surface, through the fluid chamber, and through the aperture towards the second surface.

The first surface of the substrate is typically a mounting surface of the substrate configured to be mounted on a printhead support comprising a fluid reservoir. The second surface of the substrate is typically a nozzle surface of the substrate opposite said mounting surface.

It may be that the step of forming the piezoelectric actuator at a temperature below 450° C. (or more typically below 300° C.) comprises depositing the piezoelectric actuator at a temperature below 450° C. (or more typically below 300° C.). It may be that the step of forming the piezoelectric actuator at a temperature below 450° C. (or more typically below 300° C.) comprises depositing the piezoelectric actuator by one or more physical vapour deposition methods at a temperature below 450° C. (or more typically below 300° C.).

Physical vapour deposition methods (e.g. low-temperature physical vapour deposition methods) typically comprise one or more of the following deposition methods: cathodic arc deposition, electron beam physical vapour deposition, evaporative deposition, pulsed laser deposition, sputter deposition. Sputter deposition may comprise sputtering of material from single or multiple sputtering targets.

It may be that the step of forming the at least one layer of one or more piezoelectric materials comprises depositing the at least one layer of one or more piezoelectric materials at a temperature below 450° C. (or more typically below 300° C.). It may be that the step of forming the at least one layer of one or more piezoelectric materials comprises depositing the at least one layer of one or more piezoelectric materials by physical vapour deposition methods at a temperature below 450° C. (or more typically below 300° C.).

The method may comprise performing any post-deposition processing of the one or more piezoelectric materials at a temperature below 450° C. (or more typically below 300° C.). The method may comprise annealing the one or more piezoelectric materials at a temperature below 450° C. (or more typically below 300° C.). However, more typically, the method does not comprise a post-deposition processing (e.g. annealing) step.

The step of forming the piezoelectric actuator may comprise forming a piezoelectric body from a ceramic material comprising aluminium and nitrogen and optionally one or more elements selected from: scandium, yttrium, titanium, magnesium, hafnium, zirconium, tin, chromium, boron.

The step of forming the at least one layer of one or more piezoelectric materials may consist of forming at least one layer of one piezoelectric material. Alternatively, the step of forming the at least one layer of one or more piezoelectric materials may consist of forming at least one layer of more than one piezoelectric material.

The step of forming the at least one layer of one or more piezoelectric materials may consist of forming one layer of said one or more piezoelectric materials. Alternatively, the step of forming the at least one layer of one or more piezoelectric materials may consist of forming more than one layer of said one or more piezoelectric materials.

The one or more piezoelectric materials may comprise aluminium nitride. Additional or alternatively, the one or more piezoelectric materials may comprise zinc oxide. It may be that the step of forming the piezoelectric actuator at a temperature below 450° C. (or more typically below 300° C.) (e.g. the step of forming the at least one layer of one or more piezoelectric materials at a temperature below 450° C. (or more typically below 300° C.)) comprises depositing aluminium nitride (AlN) and/or zinc oxide (ZnO) at a temperature below 450° C. (or more typically below 300° C.).

Aluminium nitride may consist of pure aluminium nitride. Alternatively, aluminium nitride may comprise one or more elements (i.e. aluminium nitride may comprise aluminium nitride compounds). Aluminium nitride may comprise one or more of the following elements: scandium, yttrium, titanium, magnesium, hafnium, zirconium, tin, chromium, boron.

It may be that the step of forming the piezoelectric actuator at a temperature below 450° C. (or more typically below 300° C.) (e.g. the step of forming the at least one layer of one or more piezoelectric materials at a temperature below 450° C. (or more typically below 300° C.)) comprises depositing scandium aluminium nitride (ScAlN) at a temperature below 450° C. (or more typically below 300° C.).

The percentage of scandium in scandium aluminium nitride is typically chosen to optimize the $d_{31}$ piezoelectric constant within the limits of manufacturability. For example, the value of x in $Sc_xAl_{1-x}N$ is typically chosen from the range $0<x\leq0.5$. Greater fractions of scandium typically result in larger values of $d_{31}$ (i.e. stronger piezoelectric effects). The mass percentage (i.e. the weight percentage) of scandium in scandium aluminium nitride is typically greater than 5%. The mass percentage (i.e. the weight percentage) of scandium in scandium aluminium nitride is typically greater than 10%. The mass percentage (i.e. the weight percentage) of scandium in scandium aluminium nitride is typically greater than 20%. The mass percentage (i.e. the weight percentage) of scandium in scandium aluminium nitride is typically greater than 30%. The mass percentage (i.e. the weight percentage) of scandium in scandium aluminium nitride is typically greater than 40%. The mass percentage (i.e. the weight percentage) of scandium in scandium aluminium nitride may be less than or equal to 50%.

It may be that the one or more piezoelectric materials comprise one or more III-V and/or II-VI semiconductors (i.e. compound semiconductors comprising elements from Groups III and V and/or Groups II and VI of the Periodic Table). Such III-V and II-VI semiconductors typically crystallise in the hexagonal wurtzite crystal structure. III-V and II-VI semiconductors crystallising in the hexagonal wurtzite crystal structure are typically piezoelectric due to their non-centrosymmetric crystal structure.

Accordingly, it may be that the step of forming the piezoelectric actuator at a temperature below 450° C. (or more typically below 300° C.) (e.g. the step of forming the at least one layer of one or more piezoelectric materials at a temperature below 450° C. (or more typically below 300° C.)) comprises depositing one or more III-V and/or II-VI semiconductors at a temperature below 450° C. (or more typically below 300° C.).

It may be that the one or more piezoelectric materials comprise non-ferroelectric piezoelectric materials. Ferroelectric materials typically require (i.e. post-deposition) poling under strong applied electric fields. Non-ferroelectric piezoelectric materials typically do not require poling. Accordingly, it may be that the step of forming the piezoelectric actuator at a temperature below 450° C. (or more typically below 300° C.) (e.g. the step of forming the at least one layer of one or more piezoelectric materials at a temperature below 450° C. (or more typically below 300° C.)) comprises depositing one or more non-ferroelectric piezoelectric materials. The method does not typically include poling the one or more piezoelectric materials after deposition.

The piezoelectric body of the piezoelectric actuator typically has a piezoelectric constant $d_{31}$ having a magnitude less than 30 pC/N, or more typically less than 20 pC/N, or even more typically less than 10 pC/N. The one or more piezoelectric materials typically have piezoelectric constants $d_{31}$ having magnitudes less than 30 pC/N, or more typically less than 20 pC/N, or even more typically less than 10 pC/N.

Forming the first electrode on the nozzle-forming layer typically comprises depositing one or more layers of metal (such as titanium, platinum, aluminium, tungsten or alloys thereof) onto the nozzle forming layer. The metal may be deposited by (e.g. low-temperature) PVD. The metal is typically deposited at a temperature below 450° C. (or more typically below 300° C.).

Forming the second electrode on the piezoelectric material typically comprises depositing one or more layers of metal (such as titanium, platinum, aluminium, tungsten or alloys thereof) onto the piezoelectric material. The metal may be deposited by (e.g. low-temperature) PVD. The metal is typically deposited at a temperature below 450° C. (or more typically below 300° C.).

The at least one electronic component may comprise at least one active electronic component (e.g. a transistor). Additionally or alternatively, the at least one electronic component may comprise at least one passive electronic component (e.g. resistor).

It may be that the step of forming at least one electronic component in or on the second surface of the substrate comprises integrally forming (e.g. integrating) said at least one electronic component in or on the substrate. It may be that the step of forming at least one electronic component in or on the second surface of the substrate comprises integrally forming (e.g. integrating) at least one CMOS (i.e. complementary metal-oxide-semiconductor) electronic component in or on the substrate.

The method may comprise forming drive circuitry on the substrate. The at least one electronic component may form part of the drive circuitry.

The drive circuitry may comprise CMOS circuitry (e.g. CMOS electronics) integrated with the substrate.

The method may comprise forming (e.g. integrally forming, for example integrating) CMOS electronic components (e.g. CMOS electronic components forming part of CMOS circuitry, i.e. CMOS electronics) in or on the substrate by way of standard CMOS manufacturing methods such as: physical vapour deposition, chemical vapour deposition, electrochemical deposition, molecular beam epitaxy, atomic layer deposition, ion implantation, photopatterning, reactive ion etching, plasma exposure.

The method may comprise integrally forming (e.g. integrating) the substrate, the at least one electronic component, the nozzle-forming layer, the piezoelectric actuator (e.g. comprising the first electrode, the at least one layer of one or more piezoelectric materials, and the second electrode), and the protective layer, thereby forming a monolithic droplet ejector.

It may be that the step of forming the nozzle-forming layer comprises forming a nozzle plate. Forming the nozzle plate may comprise depositing a single layer of material. Alternatively, forming the nozzle plate may comprise depositing two or more layers of (e.g. different) material, thereby forming a laminate structure. The nozzle plate is typically formed from one or more materials each having a Young's modulus (i.e. tensile elastic modulus) of between around 70 GPa and around 300 GPa. The nozzle plate may be formed from one or more of: silicon dioxide ($SiO_2$), silicon nitride ($Si_3N_4$), silicon carbide (SiC), silicon oxynitride ($SiO_xN_y$). The step of forming the nozzle may therefore comprise depositing one or more layers of the following materials: silicon dioxide ($SiO_2$), silicon nitride ($Si_3N_4$), silicon carbide (SiC), silicon oxynitride ($SiO_xN_y$).

It may be that the step of forming the nozzle-forming layer comprises forming an electrical interconnect layer. The step of forming the electrical interconnect layer typically comprises forming one or more electrical connections (e.g. electrical wiring) and one or more layers of electrical insulator on the second surface of the substrate. The one or more electrical connections (e.g. electrical wiring) are typically formed from a metal or metal alloy. Suitable metals include aluminium, copper and tungsten, and alloys thereof. The electrical insulator is typically formed from a dielectric material such as silicon dioxide ($SiO_2$), silicon nitride ($Si_3N_4$) or silicon oxynitride ($SiO_xN_y$).

Forming the electrical interconnect layer typically comprises depositing the one or more electrical connections and the one or more layers of electrical insulator using methods such as: ion implantation, chemical vapour deposition, physical vapour deposition, etching, chemical-mechanical planarization, electroplating, plasma exposure, photopatterning.

It may be that the method comprises: forming the electrical interconnect layer on the second surface of the substrate; and then forming the nozzle-plate on the electrical interconnect layer.

A fourth aspect of the invention provides a method of manufacturing a printhead comprising forming a plurality of droplet ejectors on a common substrate, each droplet ejector being formed by any one method according to the third aspect of the invention. The method typically further comprises mounting the common substrate onto a printhead support comprising a fluid reservoir. The printhead may be an inkjet printhead.

A fifth aspect of the invention provides a droplet ejector for a printhead, the droplet ejector comprising: a substrate having a mounting surface and an opposite nozzle surface; at least one electronic component integrated with the substrate; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer; a piezoelectric actuator formed on at least a portion of the nozzle portion of the nozzle-forming layer, the piezoelectric actuator comprising a piezoelectric body formed from aluminium nitride and/or zinc oxide, the piezoelectric body being provided between first and second electrodes, and at least one of the said first and second electrodes being electrically connected to the at least one electronic component; and a protective layer covering the piezoelectric actuator and the nozzle-forming layer.

It may be that the piezoelectric body is a PVD-deposited piezoelectric body. It may be that the piezoelectric body is a PVD-deposited piezoelectric body deposited at a temperature below 450° C. (or more typically below 300° C.).

It may be that aluminium nitride further comprises one or more of the following elements: scandium, yttrium, titanium, magnesium, hafnium, zirconium, tin, chromium, boron.

The droplet ejector may be a droplet ejector for (i.e. configured for use in) an inkjet printhead.

A sixth aspect of the invention provides a printhead comprising a plurality of droplet ejectors according to any one embodiment of the fifth aspect of the invention. It may be that the plurality of droplet ejectors share (e.g. are integrated on) a common substrate.

The printhead may be an inkjet printhead.

The printhead may be configured to print functional fluids, such as for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

A seventh aspect of the invention provides a method of manufacturing a droplet ejector for a printhead, the method comprising: providing a substrate having a first surface and a second surface opposite the first surface; forming at least one electronic component in or on the second surface of the substrate; forming a nozzle-forming layer on the second surface of the substrate; forming a first electrode on the nozzle-forming layer; forming at least one layer of aluminium nitride and/or zinc oxide on the first electrode at a temperature below 450° C.; forming a second electrode on the at least one layer of piezoelectric material; and forming a protective layer covering the piezoelectric actuator and the nozzle-forming layer.

It will be understood that the temperature at which the at least one layer of aluminium nitride and/or zinc oxide is deposited is typically the temperature of the substrate during the deposition process (i.e. it is the substrate temperature).

It may be that the step of forming at least one layer of aluminium nitride and/or zinc oxide on the first electrode at a temperature below 450° C. consists of forming said at least one layer of aluminium nitride and/or zinc oxide on the first electrode at a temperature (i.e. a substrate temperature) below 300° C.

It may be that the step of forming at least one layer of aluminium nitride and/or zinc oxide comprises of depositing said at least one layer of aluminium nitride and/or zinc oxide by physical vapour deposition.

It may be that aluminium nitride further comprises one or more of the following elements: scandium, yttrium, titanium, magnesium, hafnium, zirconium, tin, chromium, boron.

The printhead may be an inkjet printhead. The droplet ejector may be a droplet ejector for (e.g. configured for use in) an inkjet printhead. The droplet ejector may be an inkjet droplet ejector.

The printhead may be configured to print functional fluids, such as for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

An eighth aspect of the invention provides a method of manufacturing a printhead comprising forming a plurality of droplet ejectors on a common substrate, each droplet ejector being formed by the method according to any one embodiment of the seventh aspect. The method may comprise mounting the common substrate onto a printhead structure comprising a fluid reservoir.

The printhead may be an inkjet printhead.

The printhead may be configured to print functional fluids, such as for use in the manufacture of printed electronics.

The printhead may be configured to print biological fluids. Biological fluids typically comprise biological macromolecules, e.g. polynucleotides, such as DNA or RNA, microorganisms, and/or enzymes. The printhead may be configured to print other fluids used in biological or biotechnological applications, such as diluents or reagents.

The printhead may be a voxel printhead (i.e. a printhead configured for use in 3D printing, e.g. additive printing).

DESCRIPTION OF THE DRAWINGS

An example embodiment of the present invention will now be illustrated with reference to the following Figures in which:

FIG. 4(*b*) is a schematic showing drive pulse implementations for the droplet ejector device of FIG. 1;

FIG. 5(*b*) is a schematic of the manufacturing process flow for manufacturing the droplet ejector device of FIG. 1;

FIG. 5(*c*) is a schematic of the manufacturing process flow for manufacturing the droplet ejector device of FIG. 1;

FIG. 10 is a table listing some common piezoelectric materials and the manufacturing methods associated with them, along with typical $d_{31}$ values.

DETAILED DESCRIPTION OF ONE OR MORE EXAMPLE EMBODIMENTS

First Example Embodiment

The first example embodiment is described with reference to FIGS. 1 to 5.

Figure 1:
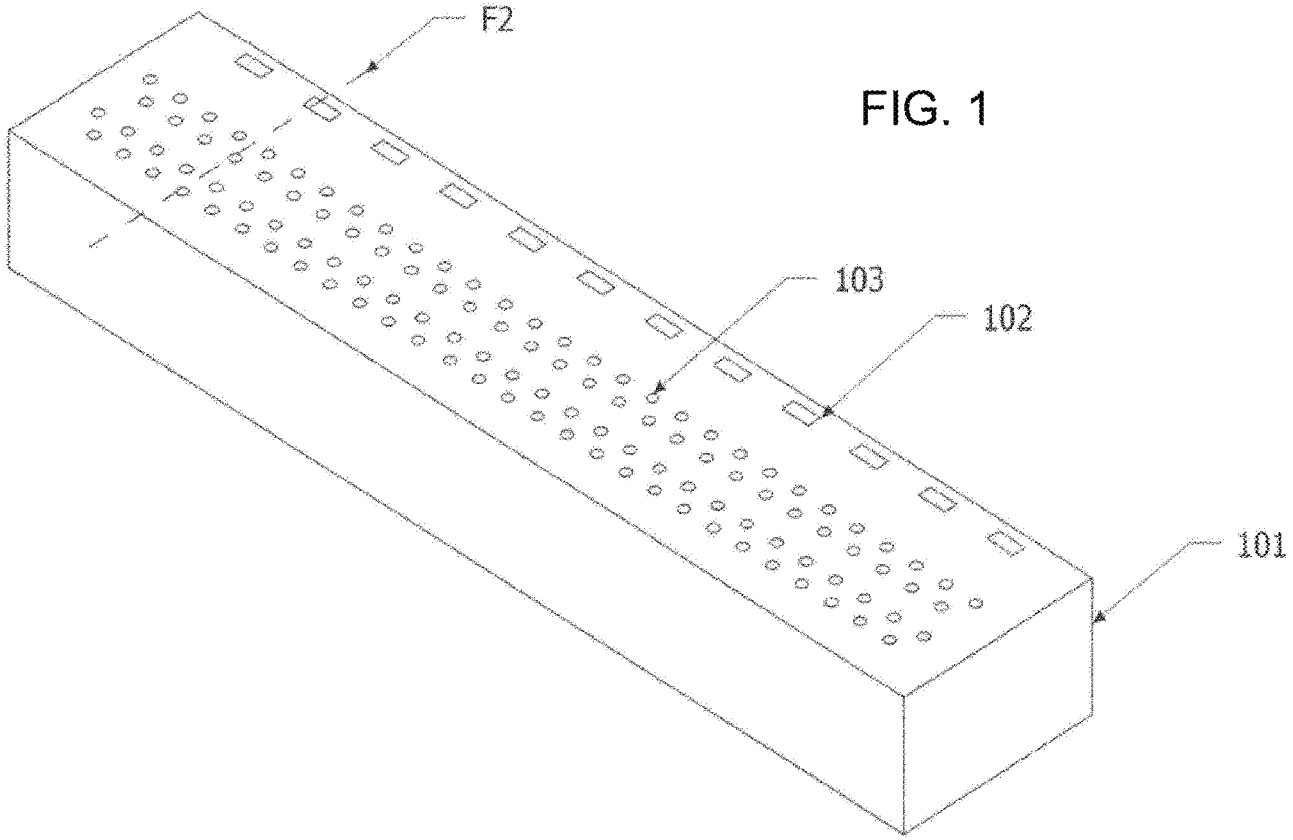
FIG. 1 is a view of a monolithic fluid droplet ejector device including integrated fluidics, electronic circuitry, nozzles and actuators according to a first embodiment.
Figure 2:
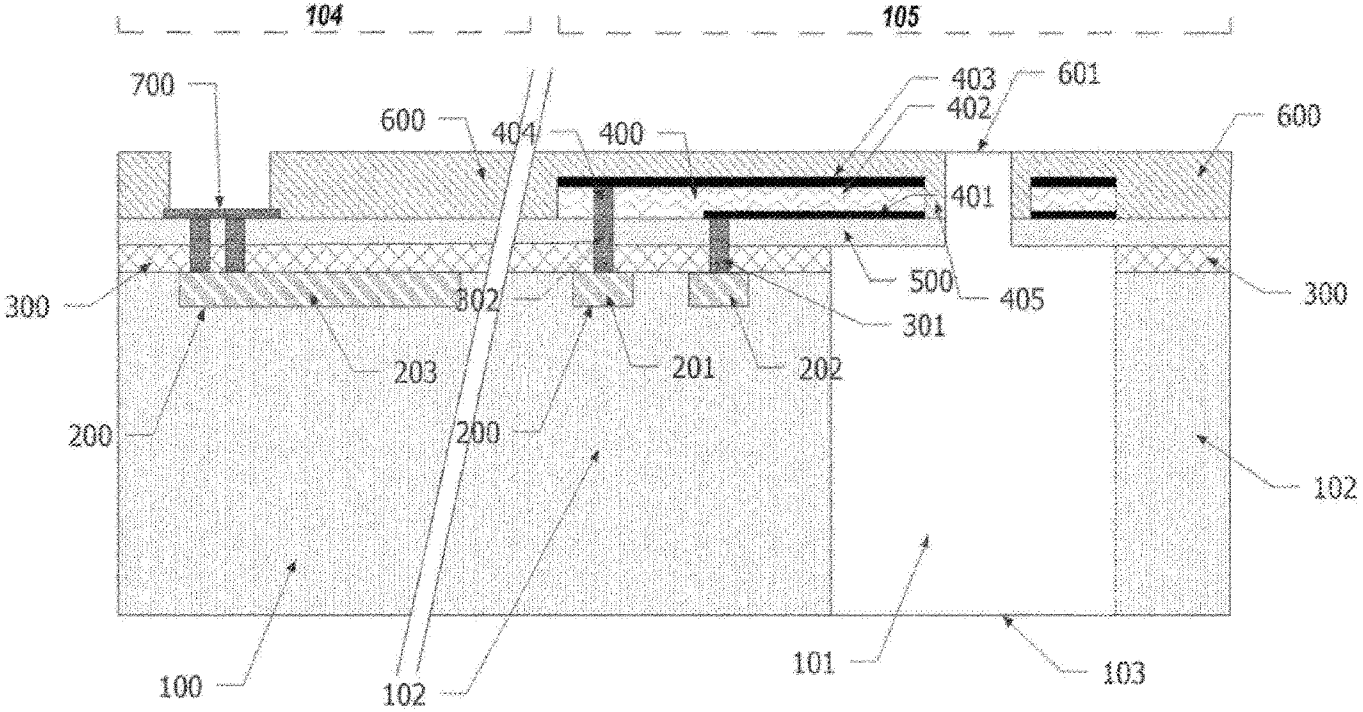
FIG. 2 is a cross sectional view of the monolithic droplet ejector device along the line F2 shown in FIG. 1.

FIG. 1 shows a monolithic fluid droplet ejector device 1 including integrated fluidics, electronic circuitry, nozzles and actuators according to the first example embodiment of the invention. FIG. 2 is a cross sectional view of the monolithic droplet ejector device 1 along the line F2 shown in FIG. 1.

As shown in FIG. 1 and FIG. 2, the fluid droplet ejector device is a monolithic chip that includes a substrate 100 fluid inlet channels 101, electronic circuitry 200, interconnect layer 300 comprising wiring, piezoelectric actuators 400, a nozzle plate 500, a protective front surface 600, nozzles 601 and bond pads 700. FIG. 1 shows a bond pad region 104, and a nozzle region 105.

The substrate 100 is typically between 20 and 1000 micrometers in thickness. The interconnect layer 300, piezoelectric actuator 400, nozzle plate 500 and protective front surface 600 are typically between 0.5 and 5 micrometers in thickness. The nozzle 601 is typically between 3 and 50 micrometers in diameter. The fluid inlet channel 103 has a characteristic dimension of between 50 and 800 micrometers.

The monolithic chip shown in FIG. 1 comprises 4 rows of nozzles. Each row is offset relative to adjacent rows in an alternating pattern. Any number of nozzle rows in different configurations are possible. The arrangement of the nozzles on the chip is configured to achieve a target print density (i.e. number of dots per inch (dpi)), a target firing frequency and/or a target print speed. A range of different nozzle configurations are possible which satisfy the particular printing requirements. Different printhead nozzle configurations are effected by arranging individual nozzle and nozzle specific drive electronics 201 and 202.

The substrate 100 is formed from a silicon wafer and comprises a supporting body 102, fluid inlet channels 101 and electronic circuitry 200.

The fluid inlet channels 101 are formed through the thickness of the substrate 100 with an opening at one surface at a fluid inlet 103 and are terminated at the other end by the nozzle plate 500 and nozzles 601. The walls of the fluid inlet channels 101 have a similar cross section through the substrate 100 and interconnect layer 300.

The fluid inlet channels 101 are substantially cylindrical (i.e. substantially circular in cross section in the plane of substrate). The corners of the fluid inlet channels 101, at the interface with the nozzle plate and at the fluid inlet interface, are rounded to minimize stress concentrations.

The electronic circuitry 200 is formed on the opposite surface of the substrate 100 to the surface that includes the fluid inlets 103. The electronic circuitry 200 can include digital and/or analog circuitry. Portions of the electronic circuitry, 201 and 202, are connected directly to the piezoelectric actuators 400 by way of wiring 301 through the interconnect layer 300 and are located close to the actuators 400 to optimize the application of a drive wave form. The electrode actuator wiring interconnects 301 and 302 may be a continuous single construction or they may be constructed from multiple layers of wiring. The drive electronics may be configured to apply a set voltage or shaped voltage to the piezoelectric actuator for a set period of time.

Portions of the electronic circuitry 203 are associated with the overall operation of the entire monolithic droplet ejector device and can be located separate to the actuator drive circuitry 201 and 202. The circuitry 203 associated with the general operation of the chip can perform a range of functionalities including data routing, authentication, chip monitoring (e.g. chip temperature monitoring), lifecycle management, yield information processing and/or dead nozzle monitoring. The circuitry 203 is connected to the bond pads 700 and the specific electrode drive circuitry 201 and 202 through the interconnect layer 300. The chip drive electronics 203 may include analog and/or digital circuits configured to perform different functions such as data caching, data routing, bus management, general logic, synchronization, security, authentication, power routing and/or input/output. The chip drive electronics 203 may comprise circuitry components such as timing circuitry, interface circuitry, sensors and/or clocks.

There may be a number of general drive electronics areas located in different sections of the chip—for example between nozzle rows or around the periphery of the chip.

The electronic drive circuitry includes 200 CMOS drive circuitry.

The interconnect layer 300 is formed directly on top of the electronics circuitry 200 and the substrate 100 and comprises electrical insulator and wiring. Wiring in the interconnect layer 300 connects chip electronic circuitry 203 to both the bond pads 700 and to the actuator electrode drive circuitry 201 and 202. The interconnect layer 300 includes power and data routing wiring which is routed between nozzles, around the periphery of the chip and/or over drive electronics. The interconnect layer 300 typically comprises multiple layers having different wiring paths.

A nozzle plate 500 is formed on top of the interconnect layer 300. The nozzle plate 500 is formed from either a single material or a laminate of multiple materials. The nozzle plate 500 is continuous across the front surface of the chip with electrical openings for wiring between the interconnect layer 300 below and actuator electrodes 401 above.

The nozzle plate 500 is formed from one or more materials which must be manufacturable with the CMOS electronic drive circuitry 200 in terms of deposition temperatures, compositions, and chemical processing steps. The nozzle plate materials must also be chemically stable and impervious to the jetted fluids. The nozzle plate materials must also be compatible with the functioning of the piezoelectric actuator. For example, the Young's modulus of suitable materials lies in the range of 70 GPa to 300 GPa. However, variations in Young's modulus can be accommodated for by changing the thickness of the nozzle plate 500. Example nozzle plate materials include one or more of (e.g. including combinations and/or laminates of) silicon dioxide ($SiO_2$), silicon nitride ($Si_3N_4$), silicon carbide (SiC) and silicon oxynitride ($SiO_xN_y$).

Each piezoelectric actuator 400 comprises a laminate of a first electrode 401, a piezoelectric layer 402 and a second electrode 403. The first electrode 401 is attached to the nozzle plate 500. The piezoelectric actuator 402 is attached to the first electrode 401. The second electrode 403 is attached to the piezoelectric actuator surface opposite the first electrode attachment surface.

The first electrode 401 is electrically connected to a wiring connection 301 in the interconnect layer 300. The second electrode 403 is electrically connected to a wiring connection 302 in the interconnect layer 300. The first electrode 401 and second electrode 403 are electrically isolated from each other. The electrode materials are electrically conductive and are typically formed from metals or intermetallic compounds such as titanium (Ti), aluminium (Al), titanium-aluminide (TiAL), tungsten (W) or platinum (Pt), or alloys thereof. These materials are manufacturable (in terms of deposition temperature and chemical process compatibility) with CMOS drive circuitry and the piezoelectric layer.

The piezoelectric actuator 402 is formed from material chosen for compatibility with the manufacture of CMOS and interconnect circuitry. CMOS drive circuitry can typically survive a temperature of up to about 450° C. However, high yield manufacturing requires a much lower peak manufacturing temperature, typically 300° C. Deposition methods that subject the CMOS drive electronics to temperatures over a duration can degrade performance, typically affecting dopant mobility and the degradation of wiring within the interconnect layer. The temperature limit restricts deposition methods for the piezoelectric layers. Suitable piezoelectric materials include aluminium nitride (AlN), aluminium nitride compounds (in particular scandium aluminium nitride (ScAlN)) and zinc oxide (ZnO), which are compatible with CMOS electronics. The composition of the piezoelectric material is chosen to optimise the piezoelectric properties. For example, the concentrations of any additional elements in aluminium nitride compounds (such as the concentration of scandium in scandium aluminium nitride) are typically chosen to optimise the magnitude of the $d_{31}$ piezoelectric constant. The higher the concentration of scandium in scandium aluminium nitride, the typically larger the value of $d_{31}$. The mass percentage of scandium in scandium aluminium nitride may be as high as 50%.

The piezoelectric actuator material is not continuous over the surface of the nozzle plate 500. The piezoelectric material is located primarily over the nozzle plate and includes a number of openings including electrode openings 404 and a region around the nozzle 405.

The protective front surface 600 is formed on the outer surface of the droplet ejector device 100 and covers the piezoelectric actuator 402, the electrodes 401 and 403, and the nozzle plate 500. The protective front surface has openings for the nozzles 601 and for the bond pads 700. The protective front surface material is chemically inert and impermeable. The protective front surface material may also be repellent to the fluid to be ejected. The mechanical properties of the protective front surface material are chosen carefully to minimize the effect on the forcing action of the piezoelectric actuator 400 and nozzle plate 500. The protective front surface material is chosen to be manufacturable with a CMOS compatible process flow, for example in terms of processing temperature and chemical process compatibility. The protective front surface 600 prevents contact of fluid with any of the electrodes 401 and 403 and piezoelectric actuator 402. Suitable protective front surface materials include polyimides, polytetrafluoroethylene (PTFE), diamond-like carbon (DLC) or related materials.

Figure 3:
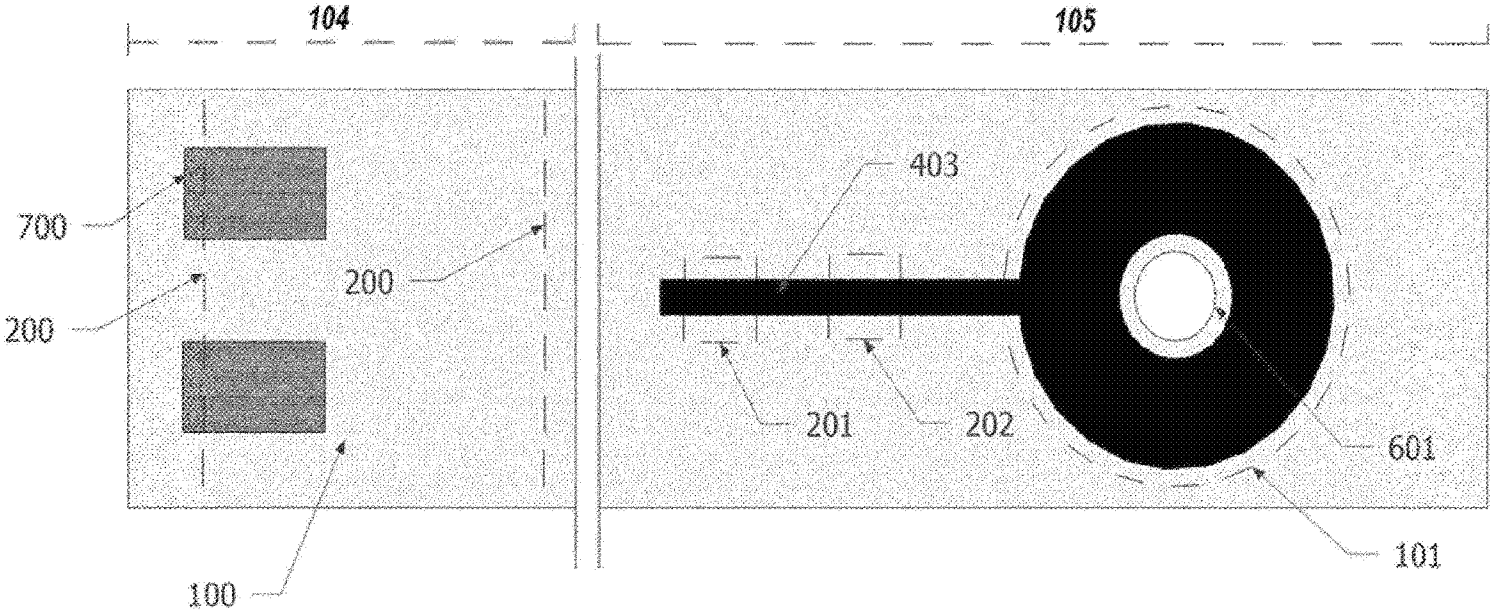
FIG. 3 is a plan view of a nozzle showing features of the monolithic droplet ejector shown in FIG. 1 with a protective coating removed.

FIG. 3 is a plan view of a nozzle showing features of the monolithic droplet ejector structure 1 with the protective coating 600 removed according to the first embodiment. The dashed line shows the underlying position of the fluid inlet 103 in relation to the piezoelectric actuator 400.

In use, the fluid droplet ejector device 1 is mounted on a substrate that can supply fluid to the fluid inlet 103. Fluid pressure is typically slightly negative at the fluid inlet 103 and the fluid inlet channels 101 typically "prime" or fill with fluid by surface tension driven capillary action. The nozzles 601 prime up to the outer surface of the protective front surface 600 due to capillary action once the fluid inlets 103 are primed. The fluid does not move onto the outer surface of the protective surface 600 past the nozzles 601 due to the combination of negative fluid pressure and the geometry of the nozzle 601.

The actuator drive circuitry 201 and 202 controls the application of a voltage pulse to the drive electrodes 401 and 403 according to a timing signal from the overall drive circuitry 203. The application of electrode voltage across the piezoelectric material 402 creates an electric field. The application of this field causes a deformation of the piezoelectric material 402. The deformation can either be tensile or compressive strain depending on the orientation of the electric field with respect to the direction of polarization in the material. The induced strain caused by the expansion or contraction of the piezoelectric materials 402 induces a strain gradient through the thickness of the nozzle plate 500, piezoelectric actuator 400 and the protective front layer 600 causing a movement or displacement perpendicular to the fluid inlet channel.

The piezoelectric properties of the piezoelectric material can be characterized in part by the transverse piezoelectric constant $d_{31}$. $d_{31}$ is the particular component of the piezoelectric coefficient tensor which relates the electric field applied across the piezoelectric material in a first direction to the strain induced in the piezoelectric material along a second direction perpendicular to said first direction. The piezoelectric actuator 400 shown is configured such that the applied electric field induces a strain in the material in a direction perpendicular to the direction in which the field is applied, and is therefore characterized by the $d_{31}$ constant.

The application of a DC or constant electric field can cause a net positive or negative displacement of the nozzle plate 500. A positive displacement of the nozzle plate is shown in FIG. 4(*a*).

The application of a pulsed electric field can cause an oscillation of the nozzle plate 500. This oscillation of the nozzle plate induces a pressure in the fluid inlet 103 under the nozzle plate 500 which causes droplet ejection out of the nozzle 601. The frequency and amplitude of the nozzle plate oscillation is primarily a function of the mass and stiffness characteristics of the nozzle plate 500, piezoelectric actuator 400, the protective layer 600, the fluid properties (for example, the fluid density, fluid viscosity (either Newtonian or non-Newtonian) and surface tension), nozzle and fluid inlet geometries and the configuration of both drive pulses.

Figure 4B:
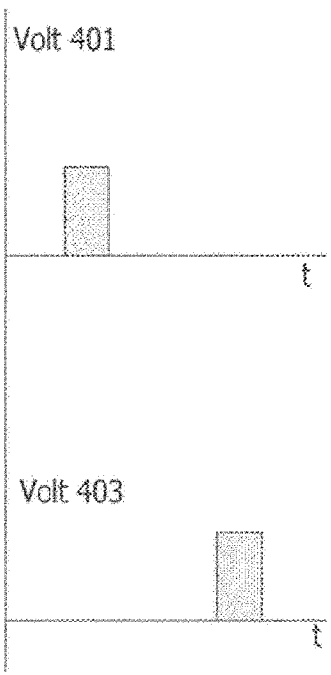
FIG. 4(*a*) is a schematic showing drive pulse implementations for the droplet ejector device of FIG. 1.
Figure 4A:
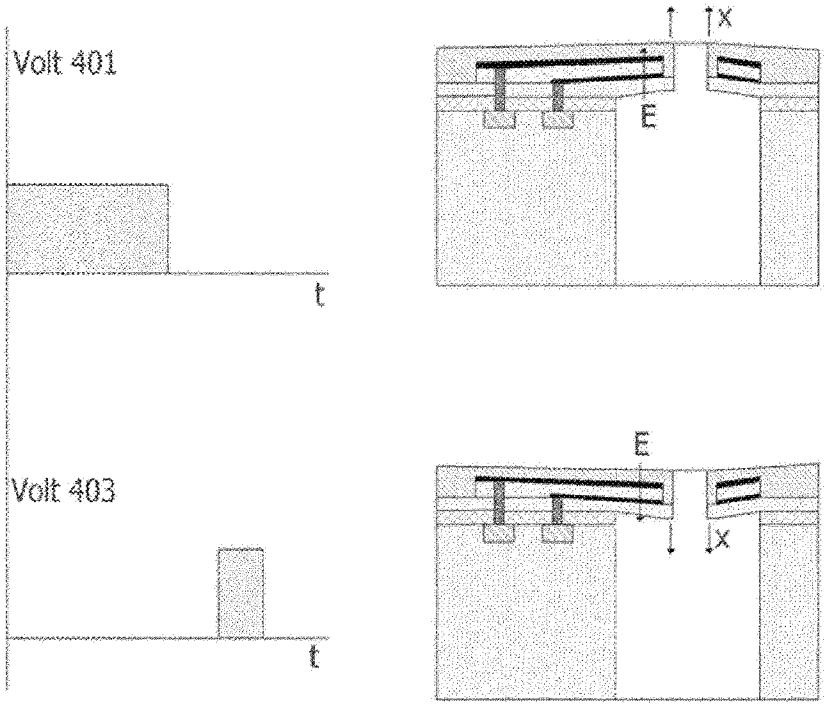

FIGS. 4(*a*)-4(*b*) show a drive pulse implementation. Voltage pulses across electrode 401 and 403 are shown. The electric field direction is labelled as E and the deflection is labelled as x.

The application of a steady state or DC electric field across the electrodes causes a contraction in the piezoelectric layer 402 and a steady state deflection of the nozzle plate away from the fluid inlet as shown in FIG. 4 (*a*). The fluid pressure under the nozzle plate is the same as the fluid inlet supply pressure. Strain energy is stored in the nozzle plate 500, the piezoelectric actuator 400 and the protective layer 600.

The electric field is removed and a reverse electric field pulse is applied as shown in FIG. 4 (*b*). This causes both a release of the stored strain energy and the application of additional expansion of the piezoelectric material 402. The actuator moves towards the fluid inlet as shown in FIG. 4 (*b*). This causes a positive pressure in the fluid inlet and nozzle region which causes droplet ejection out of the nozzle 601. The reverse electric field pulse may come immediately after the removal of the DC pulse or at a slightly delayed duration.

The final removal of the electric field across the piezoelectric material 402 causes the nozzle plate 500 to return to a position with no induced strain.

The control of two electrodes for any nozzle-actuator-nozzle plate in the device facilitates directional switching of the applied electric fields in relation to the inherent polarization of the piezoelectric material. This allows the device to incorporate stored strain energy into the nozzle plate 500 and actuator 400 structure. The release and integration of this stored strain energy augments volumetric displacements during a nozzle plate droplet ejection oscillation. The increased volumetric displacement is achieved without having to increase applied voltages and electric fields.

It is also possible to replace the DC electric field configuration described in FIG. 4(*a*) with a pulse field configuration as shown in FIG. 4(*b*). This has the advantage of minimizing any applied strain effects over longer durations. An additional advantage of the dual pulsed approach is enabled by the timing of the field pulse switching application. The application of the first pulse will induce an oscillation with an initial nozzle plate movement away from the fluid inlet as shown in FIG. 4(*b*). This oscillation will introduce a negative fluid pressure under the nozzle plate which introduces a net fluid flow towards the nozzle which can additionally augment the fluid ejection flows through the nozzle.

Figures 5A, 5B, 5C:
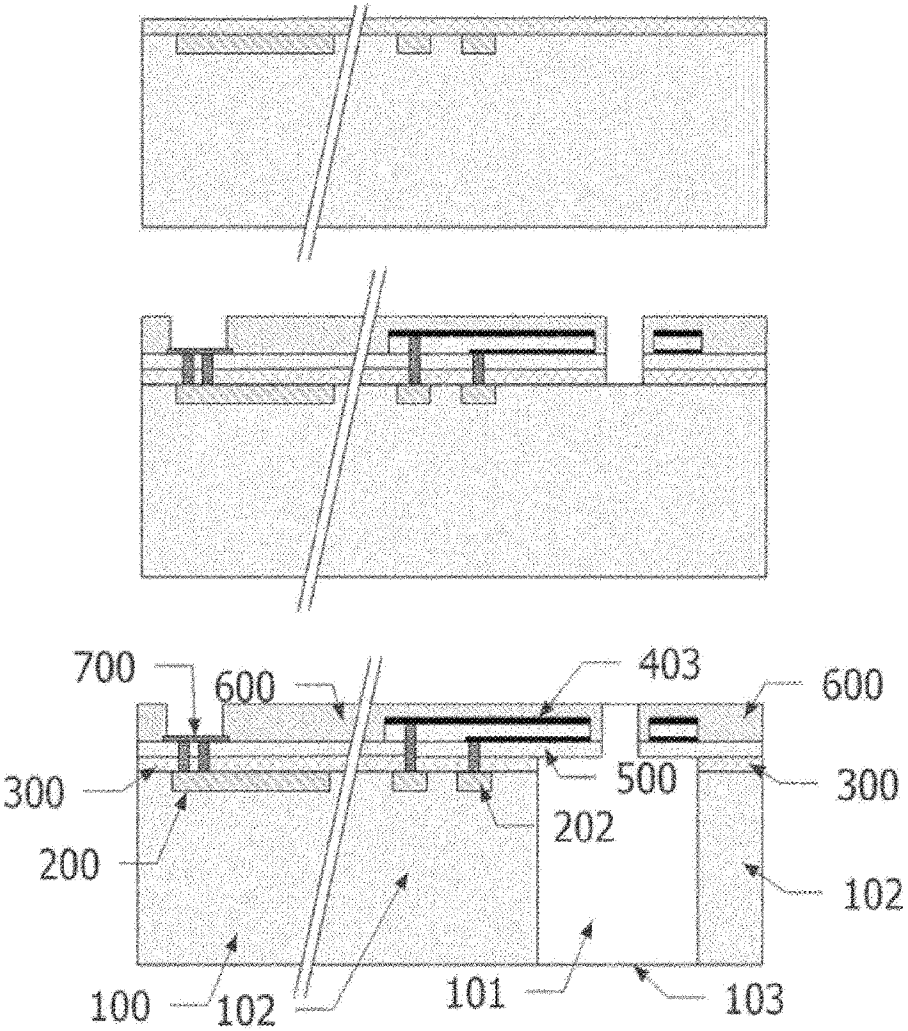
FIG. 5(*a*) is a schematic of the manufacturing process flow for manufacturing the droplet ejector device of FIG. 1.

FIGS. 5(*a*)-5(*c*) is a schematic showing the manufacturing process flow for the droplet ejector device. The first manufacturing step, as shown in FIG. 5(*a*), is to create drive circuitry and the interconnect layer 300, for example CMOS drive circuitry and interconnects, on a surface of a silicon wafer substrate. CMOS drive circuitry is formed by standard processes—for example ion implantation on p-type or n-type substrates followed by the creation of a wiring interconnect layer by standard CMOS fabrication processes (e.g. ion implantation, chemical vapour deposition (CVD), physical vapour deposition (PVD), etching, chemical-mechanical planarization (CMP) and/or electroplating).

Subsequent manufacturing steps are implemented to define features and structures of the monolithic droplet ejector device. Subsequent steps are chosen not to damage structures formed in previous steps. A key manufacturing parameter is the peak processing temperature. Problems associated with processing CMOS at high temperatures include the degradation of dopant mobility and interconnect wiring schemes. CMOS electronics are known to survive temperatures of 450° C. However, a much lower temperature (i.e. below 300° C.) is desirable for high yield.

The nozzle plate 500, the piezoelectric actuator 400, the protective layer 600 and the bond pads 700 are formed on top of the interconnect layer as shown in FIG. 5(*b*).

The nozzle plate 500 is deposited using a CVD or PVD process.

The formation of a CMOS compatible piezoelectric material 402 is of particular interest as this is the key driving element of the actuator. Table 10 shows a table listing some common piezoelectric materials and the manufacturing methods associated with them, along with typical $d_{31}$ values. It can be seen that materials with the highest $d_{31}$ values are incompatible with manufacture of monolithic CMOS structures. Materials that are compatible with CMOS structures have low $d_{31}$ values and hence a much lower forcing capability.

As can be seen from the table, although lead zirconate titanate (PZT) can be deposited by PVD (including sputtering) at low temperatures, it subsequently requires a post process anneal at a temperature above the allowable temperature for CMOS. PZT can also be deposited by sol gel methods, but this again requires a high temperature anneal above the CMOS limit. PZT also has a very slow rate of deposition that is not viable commercially. PZT additionally contains lead, which is undesirable environmentally.

ZnO, AlN and AlN compounds (such as ScAlN) materials can be deposited using low-temperature PVD (e.g. sputtering) processes that do not require post processing such as annealing. These materials also do not require poling. A poling step is required for PZT, wherein the material is subjected to a very high electric field which orients all the electric dipoles in the direction of the field.

ZnO, AlN and AlN compounds (e.g. ScAlN) materials are therefore commercially viable materials for the fabrication of a monolithic droplet ejector device. However, the value of $d_{31}$ for these materials is significantly lower than that of PZT. The particular configuration of the nozzle (i.e. the actuatable nozzle plate), which improves ejection efficiency, and the use of two control electrodes, which improves actuation efficiency (as shown in FIGS. 4(*a*)-4(*b*)), counter the lower $d_{31}$ value associated with these materials.

Piezoelectric electrode materials are deposited using a CMOS compatible process such as PVD (including low-temperature sputtering). Typical electrode materials may include titanium (Ti), platinum (Pt), aluminium (Al), tungsten (W) or alloys thereof. The electrodes are defined by standard patterning and etch methods.

Protective materials can be deposited and patterned using a spin on and cure method (suitable for polyimides or other polymeric materials). Some materials, such as PTFE, may require more specific deposition and patterning approaches.

Bond pads are deposited using methods such as CVD or PVD (e.g. sputtering).

The fluid inlet channels are defined using high aspect ratio Deep Reactive Ion Etching (DRIE) methodologies as shown in FIG. 5(*c*). The fluid inlets are aligned to the nozzle structures using a wafer front-back side alignment tool. The wafer may be mounted on a handle wafer during the front-back alignment and etch steps.

The DRIE approach may also be used to singulate the die, however, other approaches may be used such as a wafer saw.

Second Example Embodiment

Figure 6:
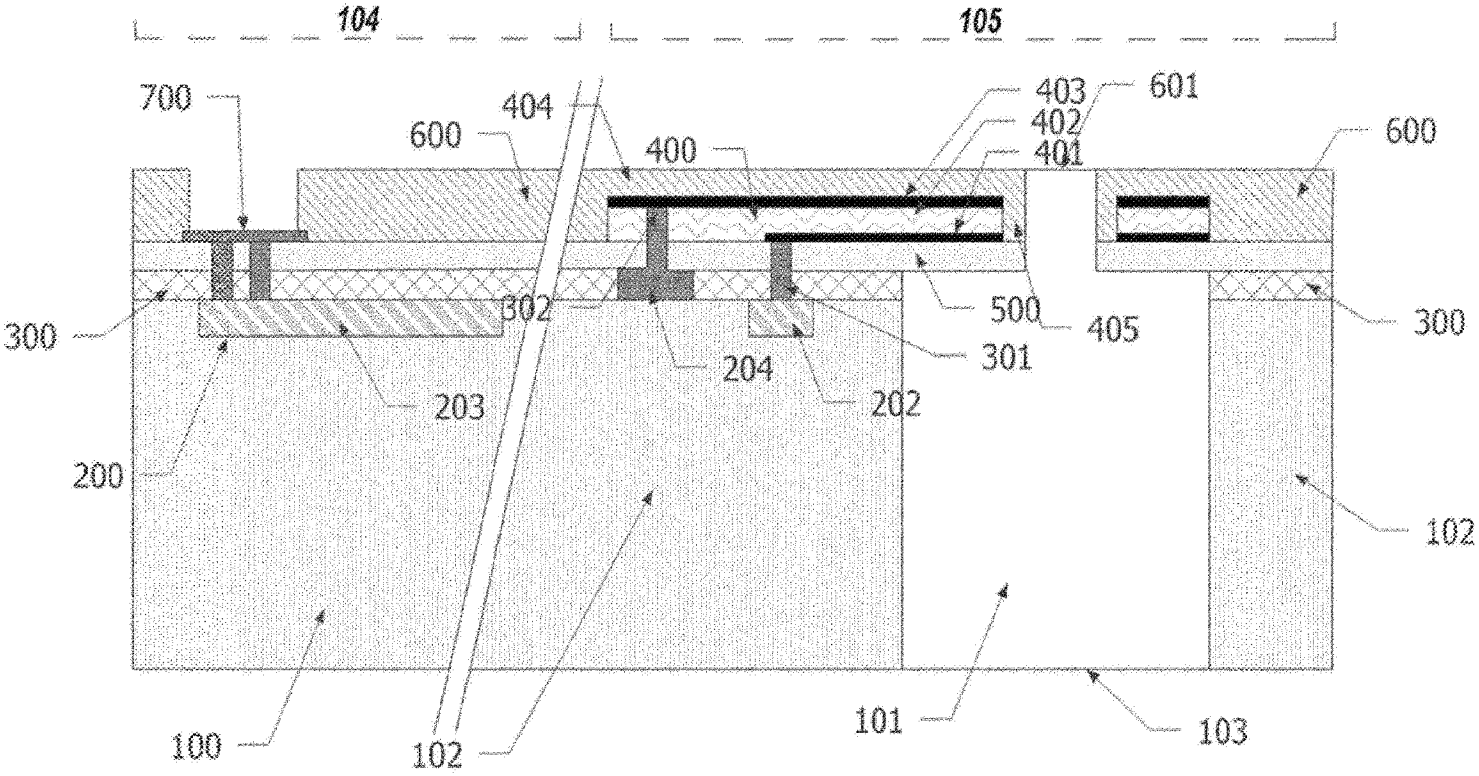
FIG. 6 is a cross sectional view showing an alternative implementation of the electrode structure according to a second example embodiment of the invention.

FIG. 6 is a cross sectional view showing an alternative implementation of the electrode structure. In this embodiment, the electrode 403, is connected by wiring, 302, to a ground line 204 rather than drive circuitry. The ground line 204 is located within the interconnect layer 300 and is connected to the drive circuitry region 203 or directly to grounded bond pads 700.

Third Example Embodiment

Figure 7:
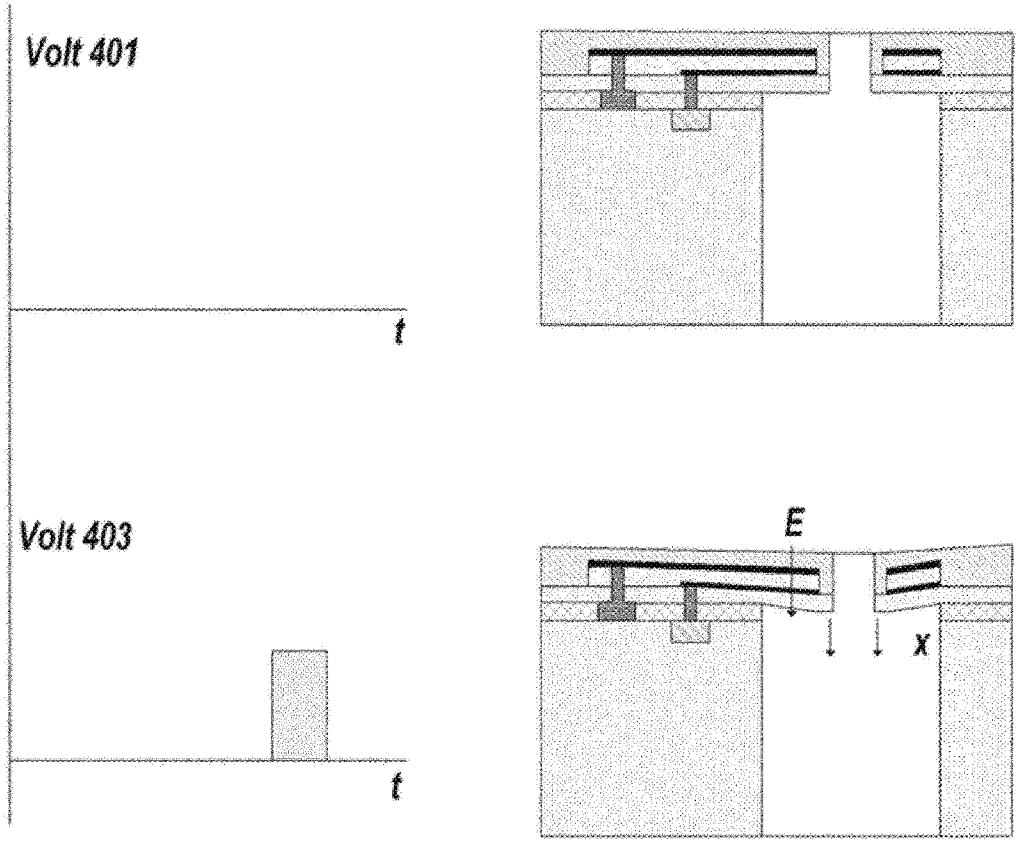
FIG. 7 is a schematic showing an alternative drive pulse implementation for the droplet ejector device of FIG. 6.

FIG. 7 is a schematic showing an alternative drive pulse implementation compatible with this droplet ejector device. A voltage pulse, as shown in FIG. 7, is applied to only one of the electrodes, for example 401. This creates an electric field through the piezoelectric actuator 400 that creates a downward displacement of the nozzle plate 500. It is also possible to configure the device with a drive pulse applied to electrode 403 and a ground voltage applied to electrode 401.

Fourth Example Embodiment

Figure 8:
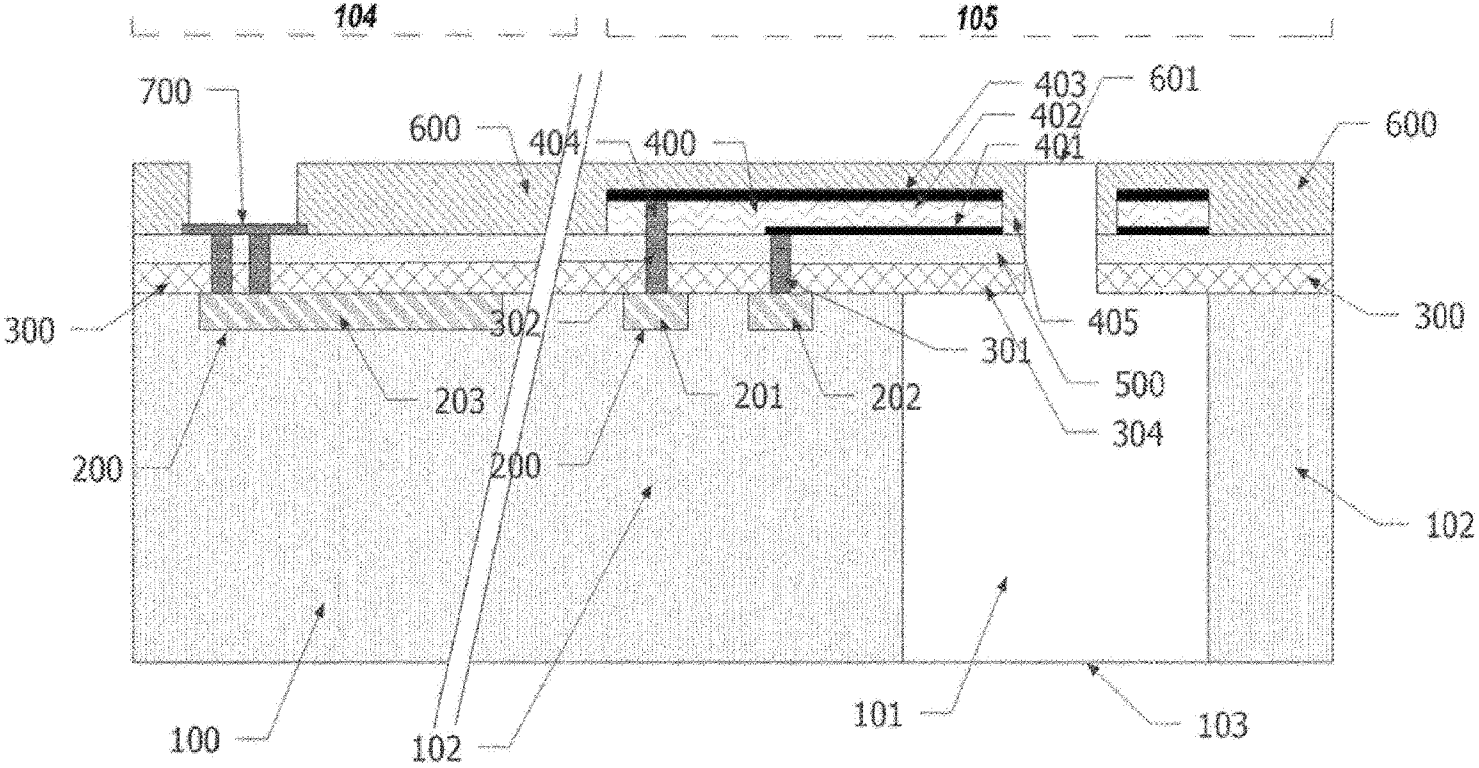
FIG. 8 is a schematic showing a cross section through an alternative implementation of the nozzle structure according to a third example embodiment of the invention.

FIG. 8 is a schematic showing a cross section of an alternative implementation of the nozzle structure and shows the extension of the interconnect layer 304 attached to the nozzle plate layer 500 in the vicinity of the fluid inlet 101. The interconnect layer extension 304 may comprise solely dielectric material without any wiring. In another variation, the device has no nozzle plate layer and only an interconnect layer attached to the piezoelectric actuator.

Fifth Example Embodiment

Figure 9:
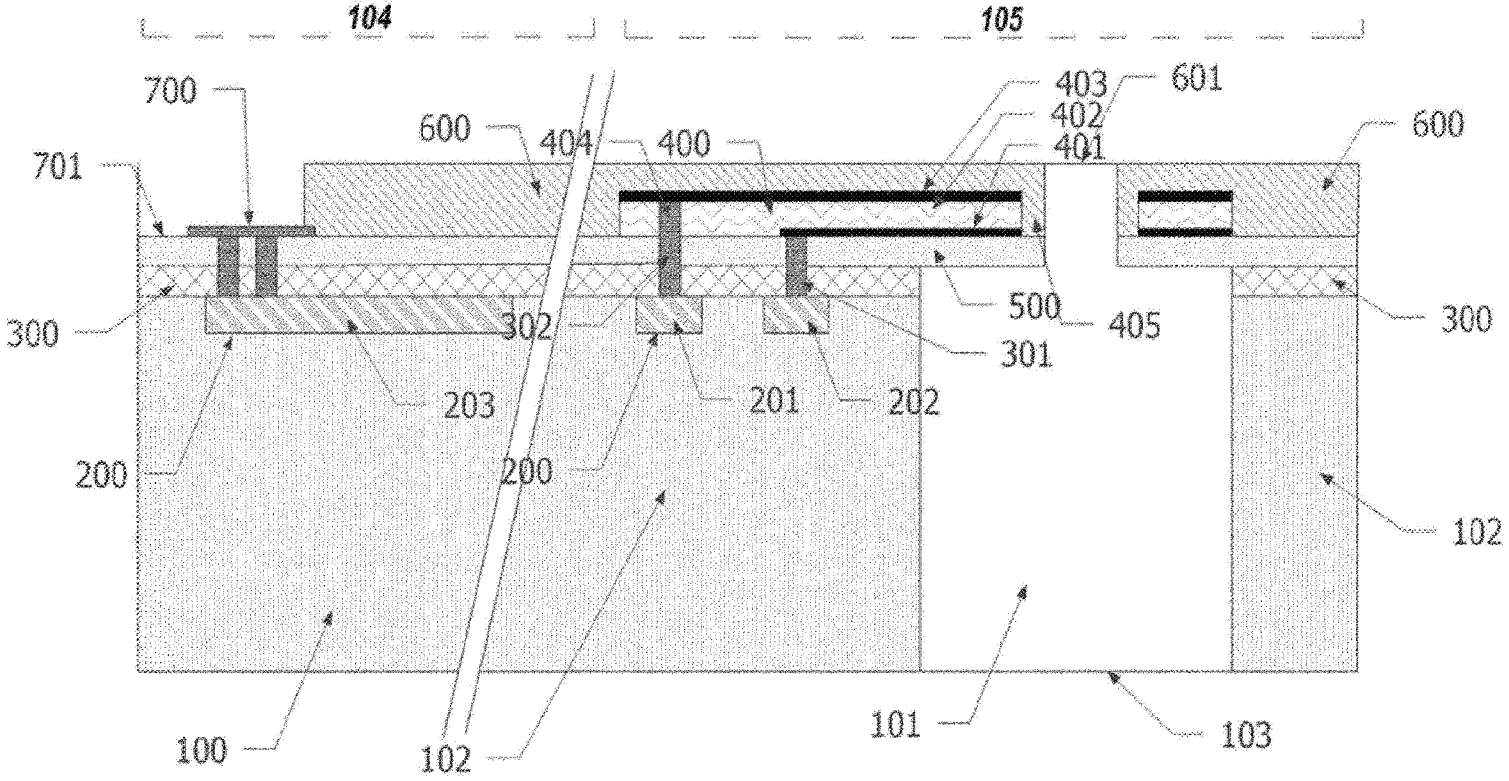
FIG. 9 is a cross-sectional view showing an alternative implementation of bond pad structures according to a fourth example embodiment of the invention.

FIG. 9 is a cross-sectional view showing an alternative implantation of the bond pad structures. The protective front surface has been removed in the vicinity of the bond pads 701. This geometry improves accessibility of external wiring schemes and reduces the overall height of wire bonding above the height of the chip.

Further variations and modifications may be made within the scope of the invention herein disclosed.

The device may be formed on a silicon wafer substrate. Alternatively, the substrate may comprise a silicon-on-insulator wafer or III-V semiconductor wafer.

The fluid inlet channels may be substantially cylindrical and therefore have substantially circular cross-sections in the plane of the substrate. Alternatively, the fluid inlet channels may take a variety of other cross-sections including multiple-sided, regular or irregular shapes. The shape of the fluid inlet channels is typically dependent on other aspects of the monolithic chip design such as the layout of nozzles, the drive electronics placement and the wiring routing in the interconnect layer 300.

The cross sectional shapes may also be selected to minimize the width of the printhead chip without introducing failure mechanisms. Failure mechanisms may be structural (for example, too many fluid inlets may reduce the robustness of the chip) or they may be operational (for example, interconnect wires may be insufficient to carry the appropriate current). A reduced printhead width is desirable because it increases the number of chips which can be manufactured on a single wafer.

The invention claimed is:

1. A droplet ejector for a printhead, the droplet ejector comprising: a substrate having a mounting surface and an opposite nozzle surface; at least one electronic component integrated with the substrate; a nozzle-forming layer formed on at least a portion of the nozzle surface of the substrate; a fluid chamber defined at least in part by the substrate and at least in part by the nozzle-forming layer, the fluid chamber having a fluid chamber outlet defined at least in part by a nozzle portion of the said nozzle-forming layer; a piezoelectric actuator formed on at least a portion of the nozzle portion of the nozzle-forming layer, the piezoelectric actuator comprising a piezoelectric body provided between first and second electrodes, at least one of the said first and second electrodes being electrically connected to the at least one electronic component, and the piezoelectric body comprising one or more piezoelectric materials processable at a temperature below 450° C.; and a protective layer covering the piezoelectric actuator and the nozzle-forming layer.

2. The droplet ejector according to claim 1, wherein the one or more piezoelectric materials are depositable at a temperature below 450° C.

3. The droplet ejector according to claim 1, wherein the one or more piezoelectric materials are PVD-deposited piezoelectric materials.

4. The droplet ejector according to claim 1, wherein the one or more piezoelectric materials comprise aluminium nitride and/or zinc oxide.

5. The droplet ejector according to claim 4, wherein the aluminium nitride further comprises one or more of the following elements: scandium, yttrium, titanium, magnesium, hafnium, zirconium, tin, chromium, boron.

6. The droplet ejector according to claim 1, wherein the piezoelectric body is formed from a ceramic material comprising aluminium and nitrogen and optionally one or more elements selected from: scandium, yttrium, titanium, magnesium, hafnium, zirconium, tin, chromium, boron.

7. The droplet ejector according to claim 1, wherein the one or more piezoelectric materials are non-ferroelectric piezoelectric materials.

8. The droplet ejector according to claim 1, wherein the piezoelectric body has a piezoelectric constant $d_{31}$ having a magnitude less than 10 pC/N.

9. The droplet ejector according to claim 1, wherein the at least one electronic component integrated with the substrate consists of at least one CMOS electronic component integrated with the substrate.

10. The droplet ejector according to claim 1, wherein said droplet ejector is a monolithic droplet ejector.

11. The droplet ejector according to claim 1, wherein the nozzle-forming layer comprises a nozzle-plate.

12. The droplet ejector according to claim 1, wherein the nozzle-forming layer comprises an electrical interconnect layer.

13. The droplet ejector according to claim 12, wherein the nozzle-forming layer comprises a nozzle-plate and the electrical interconnect layer is provided between the substrate and the nozzle plate.

14. The droplet ejector according to claim 12, wherein a nozzle portion of the electrical interconnect layer which forms at least a part of the nozzle portion of the nozzle-forming layer consists of dielectric material.

15. The droplet ejector according to claim 1, wherein the mounting surface of the substrate comprises a fluid inlet aperture in fluid communication with the fluid chamber.

16. The droplet ejector according to claim 1, wherein the fluid chamber is substantially cylindrical and the nozzle portion of the nozzle-forming layer is substantially annular.

17. A printhead comprising a plurality of droplet ejectors according to claim 1.

18. The printhead according to claim 17, wherein the plurality of droplet ejectors share a common substrate.

19. A method of manufacturing a droplet ejector for a printhead, the method comprising: providing a substrate having a first surface and a second surface opposite the first surface; forming at least one electronic component in or on the second surface of the substrate; forming a nozzle-forming layer on the second surface of the substrate; forming a piezoelectric actuator on the nozzle-forming layer at a temperature below 450° C.; forming a protective layer covering the piezoelectric actuator and the nozzle-forming layer; and forming a fluid chamber in the substrate.

20. The method according to claim 19, wherein the step of forming the piezoelectric actuator comprises: forming a first electrode on the nozzle-forming layer; forming at least one layer of one or more piezoelectric materials on the first electrode at a temperature below 450° C.; and forming a second electrode on the at least one layer of one or more piezoelectric materials.

21. The method according to claim 20, wherein the step of forming the at least one layer of one or more piezoelectric materials comprises depositing the at least one layer of one or more piezoelectric materials by physical vapour deposition at a temperature below 450° C.

22. The method according to claim 20, wherein the one or more piezoelectric materials comprise aluminium nitride and/or zinc oxide.

23. The method according to claim 20, wherein the aluminium nitride further comprises one or more of the following elements: scandium, yttrium, titanium, magnesium, hafnium, zirconium, tin, chromium, boron.

24. The method according to claim 20, wherein the step of forming the piezoelectric actuator comprises forming a piezoelectric body from a ceramic material comprising aluminium and nitrogen and optionally one or more elements selected from: scandium, yttrium, titanium, magnesium, hafnium, zirconium, tin, chromium, boron.

25. The method according to claim 20, wherein the one or more piezoelectric materials are non-ferroelectric piezoelectric materials.

26. The method according to claim 19, wherein the step of forming at least one electronic component in or on the second surface of the substrate comprises integrally forming at least one CMOS electronic component in or on the substrate.

27. The method according to claim 19 further comprising integrally forming the substrate, the at least one electronic component, the nozzle-forming layer, the piezoelectric actuator, and the protective layer thereby forming a monolithic droplet ejector.

28. The method according to claim 19, wherein the step of forming the nozzle-forming layer comprises forming a nozzle-plate.

29. The method according to claim 19, wherein the step of forming the nozzle-forming layer comprises forming an electrical interconnect layer.

30. The method according to claim 29, wherein the method comprises: forming the electrical interconnect layer on the second surface of the substrate; and then forming the nozzle-plate on the electrical interconnect layer.

31. A method of manufacturing a printhead comprising forming a plurality of droplet ejectors on a common substrate, each droplet ejector being formed by the method according to claim 19.

* * * * *